US008913785B2

(12) United States Patent
Kim et al.

(10) Patent No.: US 8,913,785 B2
(45) Date of Patent: Dec. 16, 2014

(54) APPARATUS AND METHOD FOR CALCULATING MOTION OF OBJECT

(75) Inventors: Myung Gyu Kim, Daejeon (KR); Jong Sung Kim, Daejeon (KR); Seong Min Baek, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 549 days.

(21) Appl. No.: 13/238,134

(22) Filed: Sep. 21, 2011

(65) Prior Publication Data

US 2012/0082347 A1 Apr. 5, 2012

(30) Foreign Application Priority Data

Sep. 30, 2010 (KR) ..... 10-2010-0095665
Mar. 16, 2011 (KR) ..... 10-2011-0023394

(51) Int. Cl.
*G06K 9/00* (2006.01)
*A63B 24/00* (2006.01)
*A63B 71/06* (2006.01)

(52) U.S. Cl.
CPC ..... *A63B 24/0021* (2013.01); *A63B 2220/806* (2013.01); *A63B 2220/30* (2013.01); *A63B 71/0605* (2013.01); *A63B 2220/833* (2013.01); *A63B 24/0006* (2013.01)
USPC ..... 382/103; 382/100; 382/106; 382/107

(58) Field of Classification Search
USPC ..... 382/100, 103, 106, 107
See application file for complete search history.

(56) References Cited

U.S. PATENT DOCUMENTS 7,324,663 B2 1/2008 Kiraly
2007/0213139 A1 9/2007 Stivers et al.

FOREIGN PATENT DOCUMENTS

KR 1020020005580 A 1/2002
KR 10-0871595 B1 11/2008
KR 1020090040944 A 4/2009
KR 10-0937922 B1 1/2010

OTHER PUBLICATIONS

NPL—Hubert Shum and Taku Komura, "Tracking the Translational and Rotational Movement of the Ball Using High-Speed Camera Movies", 2005 IEEE, 4 pages.*
NPL—H.Shum, T Komura, "A Spatiotemporal Approach to Extract the 3D Trajectory of the Baseball From a Single View Video Clip", ICME 2004, 4 pages.*

(Continued)

*Primary Examiner* — Wesley Tucker
(74) *Attorney, Agent, or Firm* — Ladas & Parry LLP

(57) ABSTRACT

Disclosed are an apparatus and a method for measuring a speed of a rotation body and recognizing a spin using a line scan. The present invention provides an apparatus and a method for calculating a motion of an object capable of acquiring line scan images using some lines of an area scan camera and calculating a three-dimensional speed and a three-dimensional spin of a rotation body by using a composite image in which the line scan images are coupled. The present invention can provide a realistic game or training at low cost by providing realistic physical simulation of the rotation body while allowing a competitive price when producing products by using the existing inexpensive camera.

15 Claims, 6 Drawing Sheets

(56) References Cited

OTHER PUBLICATIONS

NPL—Gueziec, "Tracking a Baseball for Broadcast Television", ACM Siggrapph 2003 Courses.*
NPL—Wolfram MathWorld , Euler's angles. 4 pages.*
Yan-Bin Jia, Curvature, Oct. 17, 2013, class note hand out, University of Iowa, 7 pages.*
Ron Goldman, Curvature formulas for implicit curves and surfaces, Rice University, Available online Jul. 21, 2005, 27 pages.*

* cited by examiner (a) (b)

APPARATUS AND METHOD FOR CALCULATING MOTION OF OBJECT

The research for this invention is supported by Ministry of Culture, Sports and Tourism(MCST) and Korea Creative Content Agency(KOCCA) in the Culture Technology(CT) Research & Development Program 2010 [Project Title: Spin and Trajectory Recognition Technology for Sports Arcade Games, Project ID: 21076020031074100003].

Electronics and Telecommunications Research Institute is charged with the research from Jul. 1, 2010 to Mar. 31, 2013.

CROSS-REFERENCE TO RELATED APPLICATIONS

This application claims priority to and the benefit of Korean Patent Application NOs 10-2010-0095665 and 10-2011-0023394 filed in the Korean Intellectual Property Office on Sep. 30, 2010 and Mar. 16, 2011, the entire contents of which are incorporated herein by reference.

TECHNICAL FIELD

The present invention relates to an apparatus and a method for calculating a motion of an object. More specifically, the present invention relates to an apparatus and a method for measuring an initial speed and a spin of a rotation body that is hit.

BACKGROUND

Technologies for measuring speed and spin of a rotation body in a simulation game are on the basis of a laser sensor or a high-speed area scan camera. As a system for measuring speed and spin of a rotation body using the laser sensor, there is a GolfAchiever system available from Focaltron Corp. On the other hand, as a system for measuring a speed and a spin of a rotation body using the high-speed area scan camera, there is a High Definition Golf system available from Interactive Sports Technologies Inc. in Canada.

However, the system using the laser sensor calculates a launching speed or a spin of a rotation body by analyzing a rotation body (ex. ball) passing through a laser optical film and a swing pass and a club head speed based on a laser image of a club. The method is precise but uses an expensive laser sensor and laser optical film device and needs to secure safety of the laser device. Therefore, the method may be difficult to apply to an inexpensive arcade game.

A system using a high-speed area scan camera, which is a Quadvision system, may three-dimensionally recover a speed, a direction, a rotation axis, and a rotation angle, or the like, of a rotation body (ex. ball) and a club by using a stereoscopic vision technology using four high-speed cameras. However, since four high-speed cameras are used, system costs have increased. Therefore, the system may also be difficult to apply to the inexpensive arcade game as well as to perform synchronization among a plurality of cameras and maintenance of these cameras.

SUMMARY OF THE INVENTION

The present invention has been made in an effort to provide an apparatus and a method for calculating a motion of an object capable of acquiring line scan images using some lines of an area scan camera and calculating a three-dimensional speed and a three-dimensional spin of a rotation body by using a composite image in which the line scan images are coupled.

An exemplary embodiment of the present invention provides, as a device for recognizing a speed and a spin of a rotation body, an image capturing device capable of capturing line scan images at high speed by performing a control to scan only some lines of the existing area scan camera.

Another exemplary embodiment of the present invention provides a method for recognizing a speed and a spin of a rotation body, including: operating one or several individual lines using any line scan image capturing device; capturing motion images of a plurality of consecutive rotation bodies for each individual line; generating composite images by coupling the motion images of the plurality of consecutive rotation bodies for each line; calculating a three-dimensional speed vector of the rotation body by using the composite image of one or several lines; and calculating the three-dimensional spin vector of the rotation body by using the composite images of one or several lines.

The generating of the composite image for each line may calculates the time coherence information for the motion images for the plurality of consecutive rotation bodies coupled to generate the composite image.

The calculating of the three-dimensional speed vector of the rotation body may calculates the three-dimensional speed of the rotation body using a method for extracting and tracking a central point for a composite image of at least two lines.

The calculating of the three-dimensional spin vector of the rotation body may calculates the three-dimensional spin of the rotation body using the method for extracting and tracking unique points for the composite image of at least two lines. The method for calculating the spin of the rotation body using the unique point may calculates the three-dimensional material frame by using at least three unique points in the composite image of each line and then uses at least two three-dimensional material frames to calculate the three-dimensional spin of the rotation body.

The calculating of the three-dimensional speed vector and the spin vector of the rotation body may calculates the change incurvature of the outside arc of the rotation body for the line scan image configuring the composite image to calculate the change in depth of the central point and the unique points and calculates the three-dimensional speed and spin of the rotation body by coupling the change in depth and two-dimensional frames.

The present invention has the following advantages. First, the exemplary embodiment of the present invention drives only some lines of the inexpensive low-speed camera to acquire the plurality of line scan images, thereby implementing the effect like the high-speed camera and configuring the system at low cost. Second, the exemplary embodiment of the present invention generates the composite image by coupling the line scan images captured for each defined time according to the motion of the rotation body, thereby calculating the speed vector and the spin vector of the rotation body. Third, the exemplary embodiment of the present invention uses, as the data, the speed vector and the spin vector of the rotation body calculated based on the composite image, thereby generating contents (ex. game contents) providing the realistic physical simulation.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
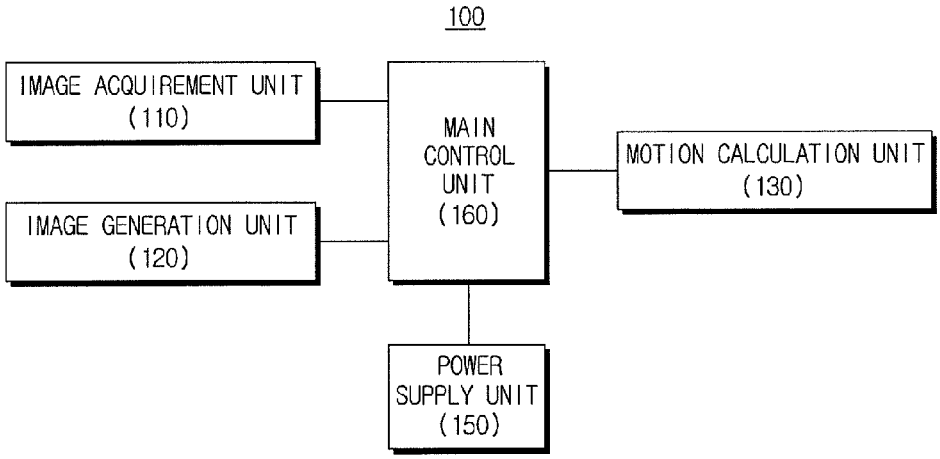
FIG. 1 is a block diagram schematically showing an apparatus for calculating a motion of an object according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings.

Figure 2:
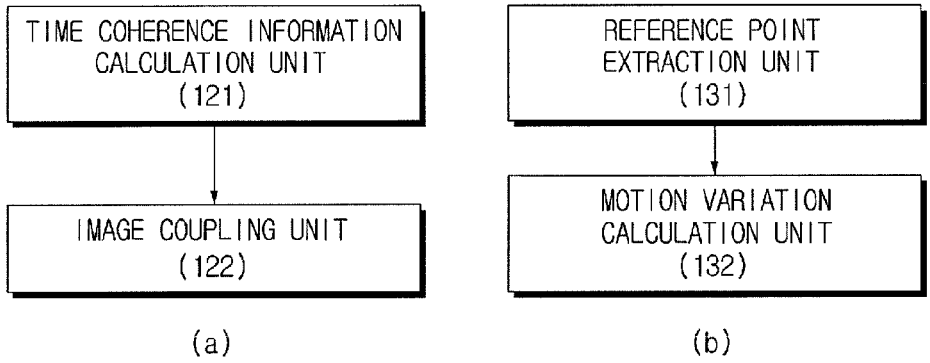
FIGS. 2 and 3 are block diagrams showing in detail an internal configuration of the apparatus for calculating a motion of an object according to an exemplary embodiment of the present invention.
Figure 3:
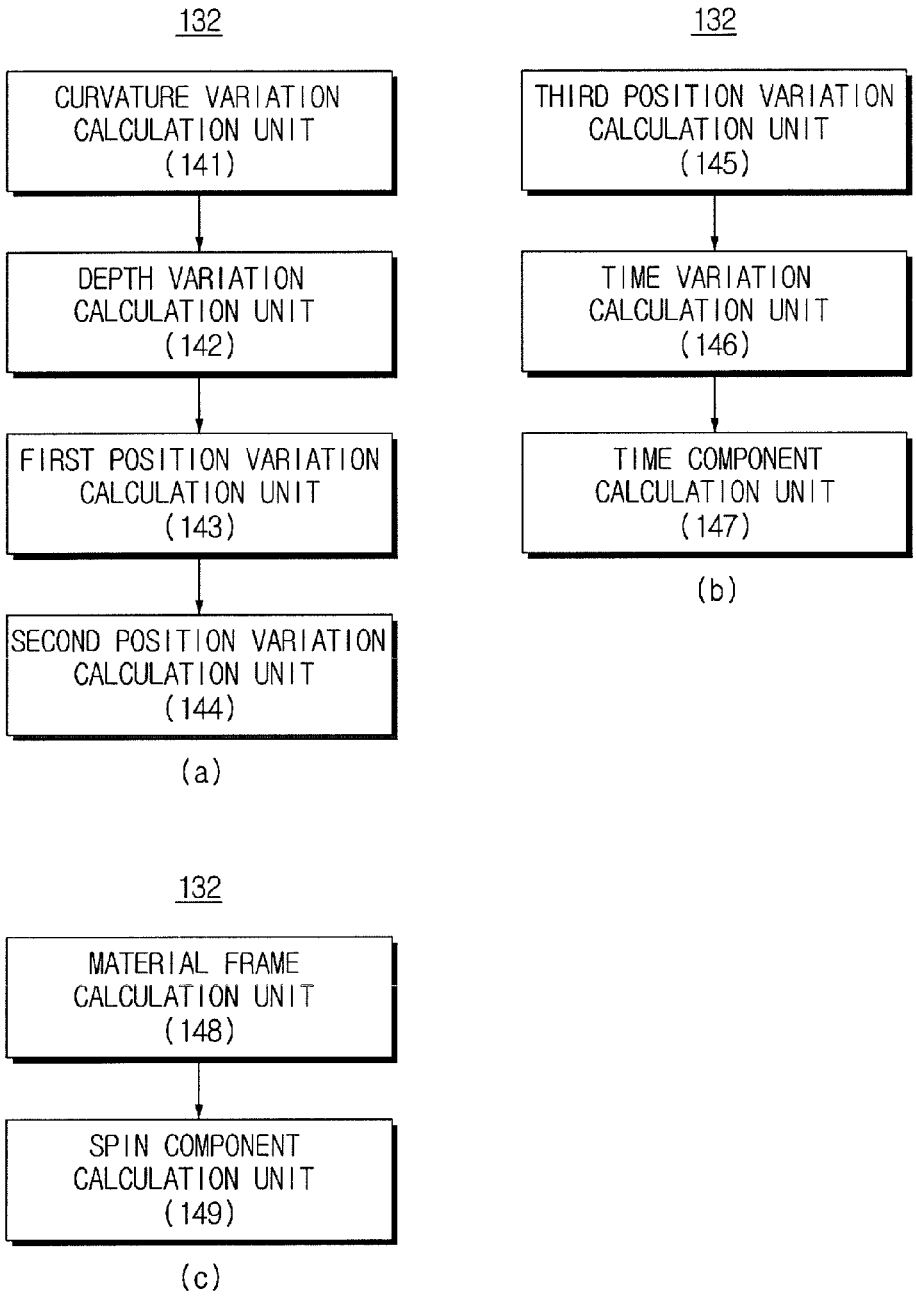

FIG. 1 is a block diagram schematically showing an apparatus for calculating a motion of an object according to an exemplary embodiment of the present invention. FIGS. 2 and 3 are block diagrams showing in detail an internal configuration of the apparatus for calculating a motion of an object according to an exemplary embodiment of the present invention. The following description will be made with reference to FIGS. 1 to 3.

Referring to FIG. 1, an apparatus 100 for calculating a motion of an object includes an image acquirement unit 110, an image generation unit 120, a motion calculation unit 130, a power supply unit 150, and a main control unit 160.

The apparatus 100 for calculating a motion of an object is an apparatus for measuring an initial speed and a spin of a rotation body that is hit. The apparatus 100 for calculating a motion of an object includes a camera that photographs a rotation body that is hit, thrown, kicked, rolled by a user during a sports arcade game at high speed effect by using only one or several lines of an inexpensive camera and a control unit that recovers an initial orbit and rotation of the rotation body and calculates a three-dimensional speed and spin of the rotation body by using a composite image in which the line scan images are coupled. In the exemplary embodiment of the present invention, the image acquirement unit 110 may be implemented by the camera and other components may be implemented by the control unit. The functions of the camera and the control unit will be described below with reference to FIGS. 4 to 8.

The image acquirement unit 110 performs a line scan on at least two sides of a rotating object to serve to acquire first images of each side. Preferably, the image acquirement unit 110 performs the line scan on one side of the object including an object-related boundary line.

The image generation unit 120 couples the acquired first images to serve to generate second images including the object. As shown in FIG. 2A, the image generation unit 120 may include a time coherence information calculation unit 121 and an image coupling unit 122. In this configuration, the time coherence information calculation unit 121 serves to calculate time coherence information on each of the first images. The image coupling unit 122 couples the first images according to the calculated time coherence information to serve to generate the second images.

The motion calculation unit 130 serves to calculate motion variations of an object based on the generated second images. As shown in FIG. 2B, the motion calculation unit 130 may include a reference point extraction unit 131 and a motion variation calculation unit 132. The reference point extraction unit 131 serves to extract a reference point predefined in each of the second images. As the reference point, there are a central point, a unique point, and the like. The motion variation calculation unit 132 serves to calculate three-dimensional position variation of the reference point as motion variation, speed component of an object, and spin component of an object based on the extracted reference points. For example, the motion variation calculation unit 132 may use the central point as the reference point when calculating the speed component of the object and use the unique point as the reference point when calculating the spin component of the object.

The motion variation calculation unit 132 may include a curvature variation calculation unit 141, a depth variation calculation unit 142, a first position variation calculation 143, and a second position variation calculation unit 144 when calculating the three-dimensional position variation of the reference point as the motion variation, as shown in FIG. 3A. The curvature variation calculation unit 141 serves to calculate the curvature variation of a boundary line (ex. outside arc) related to objects for each of the second images. The depth variation calculation unit 142 serves to calculate the depth variation of the reference point based on the curvature variation for each of the second images. The first position variation calculation unit 143 serves to calculate two-dimensional position variation of the reference point from the second images. The second position variation calculation unit 144 serves to calculate three-dimensional position variation of the reference point based on the depth variation and the two-dimensional position variation.

When the speed component of the object is calculated as the motion variation, the motion variation calculation unit 132 may include a third position variation calculation unit 145, a time variation calculation unit 146, and a speed component calculation unit 147, as shown in FIG. 3B. The third position variation calculation unit 145 obtains the position component (ex. three-dimensional position vector) for the reference point in each of the second images to serve to calculate the position variation between the second images. The time variation calculation unit 146 serves to calculate the time variation between the second images based on the position component obtained for each of the second images. The speed component calculation unit 147 serves to calculate the speed component of the object based on the position variation and the time variation.

When the spin component of the object is calculated as the motion variation, the reference point extraction unit 131 extracts unique points having different frame values as a reference point in each of the second images and the motion variation calculation unit 132 may include a material frame calculation unit 148 and a spin component calculation unit 149 as shown in FIG. 3C. The material frame calculation unit 148 uses the extracted unique points to serve to calculate a three-dimensional material frame system for the second images. The spin component calculation unit 149 serves to calculate the spin component of the object based on the three-dimensional material frame system.

Meanwhile, the motion variation calculation unit 132 uses the motion blur features of each of the second images to calculate the spin component of the object. The motion variation calculation unit 132 may model the three-dimensional motion of the object based on the second images and calculate the spin component of the object based on the stereoscopic shape of the object built by the modeling.

The power supply unit 150 serves to supply power to each component configuring the object motion calculation device 100.

The main control unit 160 serves to control the entire operation of each component configuring the object motion calculation device 100.

Next, the object motion calculation device 100 will be described as an example. The present invention relates to an apparatus and/or a method for measuring (or recognizing) a speed and/or a spin of the rotation body having an effect like the high-speed camera by driving only one or a plurality of lines of the camera. The present invention drives only one or a plurality of lines of the camera to capture the plurality of line scan images, generates the composite image by coupling each of the plurality of captured line scan images for each line, calculates the frame change based on the curvature of arc of the generated composite images, and calculates the speed and/or spin of the rotation body based on the calculated frame change.

Figure 4:
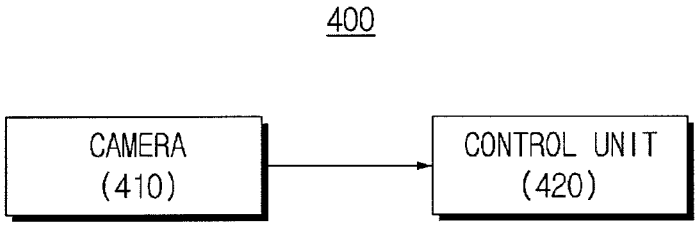
FIG. 4 is a diagram showing an example of the apparatus for calculating a motion of an object according to an exemplary embodiment of the present invention.

FIG. 4 is a block diagram showing a configuration of an apparatus 400 for measuring the speed and/or spin of the rotation body according to an exemplary embodiment of the present invention. Referring to FIG. 4, the apparatus 400 for measuring the speed and/or spin of the rotation body includes a camera 410 and a control unit 420.

The apparatus 400 is to recognize the three-dimensional speed vector and the three-dimensional spin vector of the rotation body and proposes the high-speed line scan image capturing device scanning only some lines in the existing camera device by using only the line scan. The apparatus 400 may obtain the effect of accurately recognizing the three-dimensional speed and spin of the rotation body when the rotation body is launched.

Figure 5:
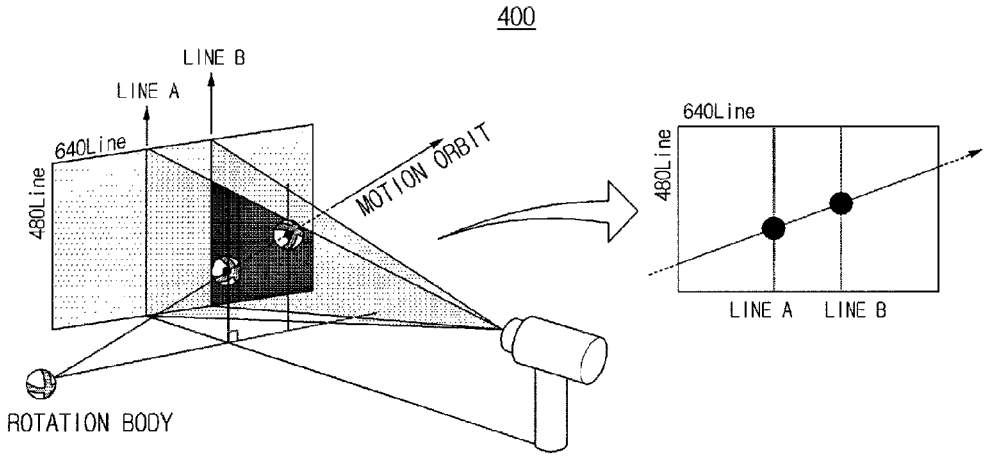
FIG. 5 is a configuration diagram showing a camera capturing a line scan image in the exemplary embodiment of the present invention.

The camera 410 processes an image frame such as still pictures, moving pictures, or the like, obtained by at least one image sensor. That is, the corresponding image data obtained by the image sensor are decoded according to codec so as to meet each standard. The image frame processed in the camera 410 may be displayed on a display unit (not shown) or stored in the storage unit (not shown) by the control of the control unit 420. The camera 410 captures (photographs) the line scan image for any rotation body by the control of the control unit 420. That is, as shown in FIG. 5, the camera 410 of 480×640 type captures the predetermined number of lines (for example, one line or two lines, or the like) among 640 lines by the control of the control unit 420 rather than capturing the area image configured of total 640 lines by 30 frames per second. Therefore, for example, when the camera 410 captures one line, the camera 410 may capture the line scan image by 640×30=19200 frame per second. As another example, when the camera 410 captures two lines (for example, line A and line B), the camera 410 may capture the line scan image by 320×30=9600 frame per second.

Figure 6:
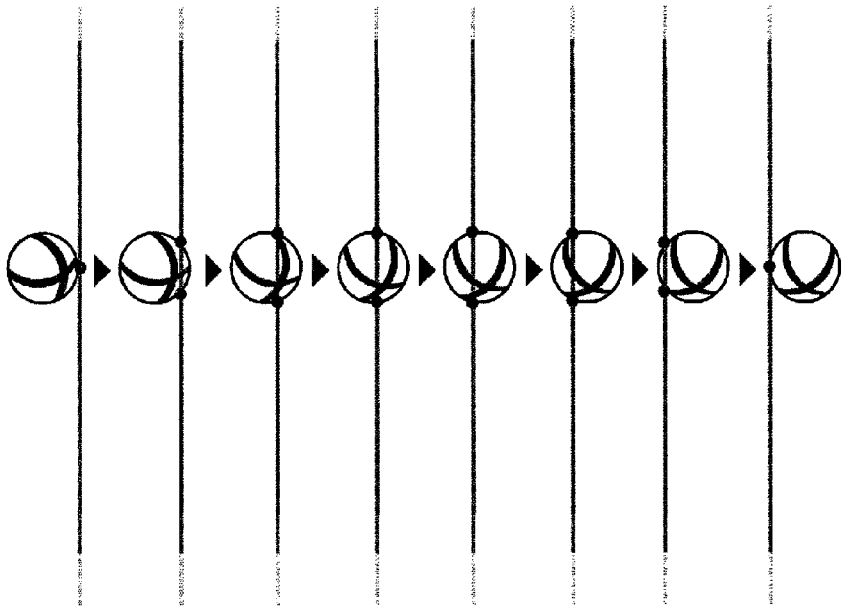
FIG. 6 is a diagram showing a method for capturing a plurality of line scan images for each line by the camera in the exemplary embodiment of the present invention.

FIG. 6 shows 8 line images for each line captured by two predetermined line scan cameras 410 according to an exemplary embodiment of the present invention. For example, when the speed of the rotation body is 180 km per hour, that is, 50 m per second and the diameter of the rotation body is 0.05 m, the time consumed for the rotation body to move the diameter distance is (0.05 m)/(50 m/sec)=0.001 sec. Therefore, two line scan cameras 410 capture 9600 line images per second, such that each line captures the rotation body 9600×0.001=9.6 times. When the rotation body is smaller, the camera 410 may capture the rotation body about 8 times, which may be the exemplary embodiment as shown in FIG. 6. When the rotation body is slower, the camera 410 may capture a large number of line images.

The camera 410 may configure a single input unit (not shown) together with a mike (not shown). In this configuration, the input unit receives signals according to the button operation by the user or receives the commands or the control signals generated by the operation such as touching/scrolling the displayed screen, or the like.

As the input unit, various devices such as a keyboard, a key pad, a dome switch, a touch pad (constant voltage/constant current), a touch screen, a jog shuttle, a jog wheel, a jog switch, a mouse, a stylus pen, a touch pen, a laser pointer, or the like, may be used. In this configuration, the input unit receives signals corresponding to an input by various devices.

The mike receives external acoustic signals including acoustic signals according to the movement of the rotation body by a microphone and converts the external acoustic signals into electrical data. The converted data are output through a speaker (not shown). The mike may use various noise removal algorithms so as to remove noises generated during the process of receiving the external acoustic signals.

The control unit 420 controls a general operation of the apparatus 400 for measuring a speed and/or a spin of the rotation body.

Figure 7:
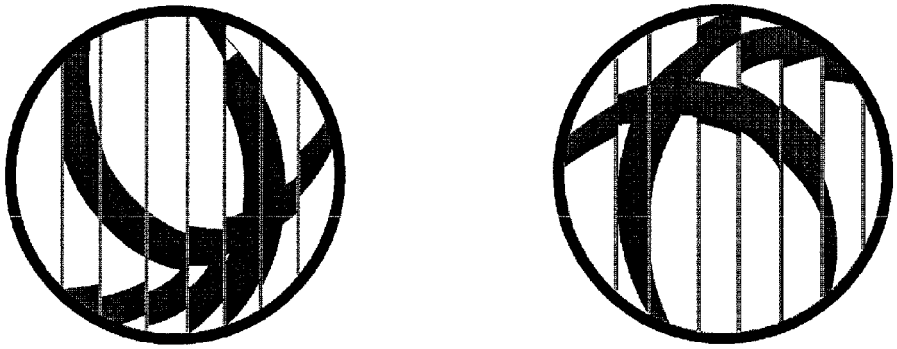
FIG. 7 is a diagram showing a composite image obtained in the exemplary embodiment of the present invention.

The control unit 420 couples the plurality of line scan images captured by the camera 410 for at least one predetermined line to generate the composite images for each line. That is, the control unit 420 calculates the time coherence information on the plurality of consecutive line scan images coupled of the rotation body and couples the plurality of line scan images based on the calculated time coherence information to generate the composite images. In this configuration, as shown in FIG. 7, the control unit 420 couples 8 line scan images obtained for each of the two lines to generate the composite images for each of the two lines, in FIG. 6, thereby recovering the initial orbit and rotation of the rotation body. In this configuration, FIG. 7A shows the composite image in which the plurality of line scan images scanned (captured) from line A of FIG. 6 are coupled and FIG. 7B shows the composite images in which the plurality of line scan images scanned from line B of FIG. 6 are coupled. As described above, in the line scan image configuring the composite images, a curvature of an outside arc of a portion of the rotation body (for example, a spherical shape) may be constant or changed. That is, the case in which the curvature of the rotation body is constant corresponds to the case in which the depth for the camera 410 is constant and the case in which the curvature of the rotation body is changed corresponds to the case in which the depth for the camera 410 is changed. Therefore, the change in depth based on the change in curvature can be appreciated and the change in three-dimensional frames can be confirmed by coupling the change in depth and the change in a two-dimensional frame.

For example, when a real radius of the rotation body is a, a distance between the rotation body and the camera 410 is z0, and when a radius of an arc of the captured line scan image is r0, the radiuses of the arcs of the first and last line scan images each are ri and rf, respectively, the control unit 120 may calculate lengths zi and zf of the rotation body, in which the first and final line scans are captured, by the following Equation.

$$Zi=z0\times(ri/r0) \quad \text{[Equation 1]}$$

$$Zf=z0\times(rf/r0) \quad \text{[Equation 2]}$$

The control unit 420 may calculate the three-dimensional frames x, y, and t of the rotation body by the following Equation when the frames of the central point of the composite image are x and y.

$$(x,y,t)=(x,y,(zi+zf)/2) \quad \text{[Equation 3]}$$

The control unit 420 calculates the three-dimensional speed vector and/or the three-dimensional spin vector of the rotation body based on the generated composite images. That is, the control unit 420 calculates the three-dimensional speed of the rotation body using a method for extracting and tracking the central point for the generated composite images. The control unit 420 calculates the three-dimensional spin of the rotation body using the method for extracting and tracking feature points for the generated composite images. In this case, the control unit 420 calculates a three-dimensional material frame using at least three feature points (or, unique points) in the composite image and may calculate the three-dimensional spin of the rotation body using the information on at least two calculated three-dimensional material frames. The control unit 420 may calculate the change in curvature of the outside arc of the rotation body of the line scan image configuring the composite image, calculate the change in depth of the central point and the unique points, and calculate the three-dimensional speed and spin of each rotation body by coupling the change in calculated depth with the change in a two-dimensional frame.

The control unit 420 provides the calculated three-dimensional speed and/or spin of the rotation body to any terminal. The corresponding terminal uses the three-dimensional speed and/or spin as the initial value, thereby providing the realistic physical simulation for the motion orbit such as a flight motion or a ground motion of the rotation body by using the three-dimensional speed and/or spin of the rotation body as the initial value and providing the realistic simulation based game or training contents.

The apparatus 400 for measuring a speed and a spin of the rotation body may further include a storage unit (not shown) storing data and program, or the like, which need to operate the apparatus 400 for measuring a speed and a spin of the rotation body. In this case, the storage unit stores an algorithm for the method for extracting and tracking the central point for any image used to calculate the speed vector of the rotation body, an algorithm for the method for extracting and tracking the feature points for any image used to calculate the spin vector of the rotation body, or the like.

The storage unit may include at least one storage medium of a flash memory type, a hard disk type, a multimedia card micro type, a card type memory (for example, SD or XD memory, or the like), a magnetic memory, a magnetic disk, an optical disk, a random access memory (RAM), a static random access memory (SRAM), a read-only memory (ROM), a programmable read-only memory (PROM), and an electrically erasable programmable read-only memory (EEPROM), The apparatus 400 for measuring a speed and/or a spin of a rotation body may further include a display unit (not shown) displaying an image (video) captured by the camera 410 by the control of the control unit 420. In this case, the display unit may include at least one of a liquid crystal display (LCD), a thin film transistor-liquid crystal display (TFT LCD), an organic light-emitting diode (OLED), a flexible display, a field emission display (FED), and a three-dimensional display (3D display).

The display may include at least two displays according to the implementation type of the apparatus 400 for measuring a speed and/or a spin of a rotation body. For example, in the apparatus 400 for measuring a speed and/or a spin of a rotation body, the plurality of displays may be disposed on one plane (co-plane) to be spaced apart from each other or to be integrated and may each be disposed on different planes.

The display may be used as an input device in addition to an output device when the display includes a sensor sensing the touch operation. That is, when the touch sensor such as a touch film, a touch sheet, a touch pad, or the like, is disposed on the display, the display may be operated as the touch screen.

The apparatus 400 for measuring a speed and/or a spin of the rotation body may further include a communication unit (or wireless communication module) that performs a wired/wireless communication function with any external terminal. In this case, the communication unit may include a module for wireless Internet connection or a module for short range communication. In this case, the wireless Internet technology may include wireless LAN (WLAN), wireless broadband (Wibro), a Wi-Fi, world interoperability for microwave access (Wimax), high speed downlink packet access (HSPDA), or the like. The short range communication technology may include Bluetooth, ZigBee, ultra wideband (UWB), radio frequency identification (RFID), infrared data association (IrDA), or the like. The wired communication technology may include universal serial bus (USB) communication.

As described above, the apparatus 400 for measuring a speed and/or a spin of a rotation body captures the plurality of line scan images for each line by driving at least one line of the camera, generates the composite images for each line by coupling the plurality of captured line scan images, and calculates a speed and a spin of a rotation body based on the generated composite images.

Next, the method for measuring a speed and/or a spin of a rotation body according to an exemplary embodiment of the present invention will be described. Hereinafter, the method will be described with reference to FIGS. 4 to 7.

First, the camera 410 captures the plurality of line scan images (alternatively, motion image of a plurality of consecutive rotation bodies for any moving (motion) rotation body for at least one predetermined line (one or a plurality of lines). In this case, any moving rotation body may be a rotation body that is hit, thrown, kicked, or rolled by any user with or without using a tool (a golf club, a bat, or the like).

For example, the camera 410 captures the plurality of consecutive line scan images for each line for the two predetermined lines (line A and line B) as shown in FIG. 5.

The control unit 420 couples the plurality of line scan images for each line captured by the camera 410 to generate the composite images. That is, the control unit 420 calculates the time coherence information on the plurality of consecutive line scan images for each line captured by the camera 410 and generates the composite images by coupling the plurality of line scan images based on the calculated time coherence information.

For example, the control unit 420 couples the line scan images of 8 consecutive rotation bodies obtained for each of the two lines (line A and line B) to generate the composite images for each of the two lines, as shown in FIGS. 6 and 7.

The control unit 420 calculates the three-dimensional speed vector of the rotation body based on the generated composite images. That is, the control unit 420 obtains the three-dimensional position vector of the central point of the rotation body for the generated composite image to track the change according to the time. The control unit 420 obtains the three-dimensional speed vector of the rotation body from the difference in the three-dimensional position vector of the central point of the rotation body and the time difference.

For example, the control unit 420 may obtain the three-dimensional speed vector of the rotation body by the following Equation when the frames of the central points of the first and second composite images each are (x1, y1, z1) and (x2, y2, z2) and the time difference is dt.

$$((x2-x1)/dt,(y2-y1)/dt,(z2-z1)/dt) \quad \text{[Equation 4]}$$

In this case, z1 and z2 may be obtained using Equations 2 and 3, and z1=(zi1+zf1)/2, and z2=(zi2+zf2)/2.

The control unit 420 calculates the three-dimensional spin vector of the rotation body based on the generated composite image. That is, the control unit 420 obtains the three-dimensional position vectors of the feature points of the rotation body for the generated composite image to track the change according to the time. The control unit 420 obtains the three-dimensional spin vector of the rotation body from the difference of the three-dimensional position vector and the time difference of the feature points of the rotation body. In this case, the control unit 420 may obtain the three-dimensional spin vector of the rotation body based on the feature point by using a method for obtaining a spin based on a motion blur features on the image generated by a consecutive motion during an exposure time from the single scan line image of the rotation body, a method for obtaining a spin by directly using the three-dimensional model based features, or the like.

For example, the control unit 420 calculates the three-dimensional material frame based on at least three feature points in the generated composite images and calculates the three-dimensional spin of the rotation body based on at least two calculated three-dimensional frame information.

Since the curvature of the outside arc of a portion of the rotation body in the line scan image of the consecutive rotation bodies configuring the composite images may be constant or changed, when the curvature of the rotation body is constant, the control unit 420 can confirm the change in depth based on the change in curvature using characteristics when the depth for the camera 410 is changed and the change in the three-dimensional frame by coupling the confirmed change in depth and the change in two-dimensional frame.

That is, the control unit 420 may calculate the change in curvature of the outside arc of the rotation body of the line scan image configuring the composite image, calculate the change in depth of the central point and the feature point of the rotation body, respectively, and calculate the three-dimensional speed vector and spin vector of the rotation body, respectively, by coupling the change in calculated depth and the change in the two-dimensional frame, when the three-dimensional speed vector or the spin vector of the rotation body is calculated.

Figure 8:
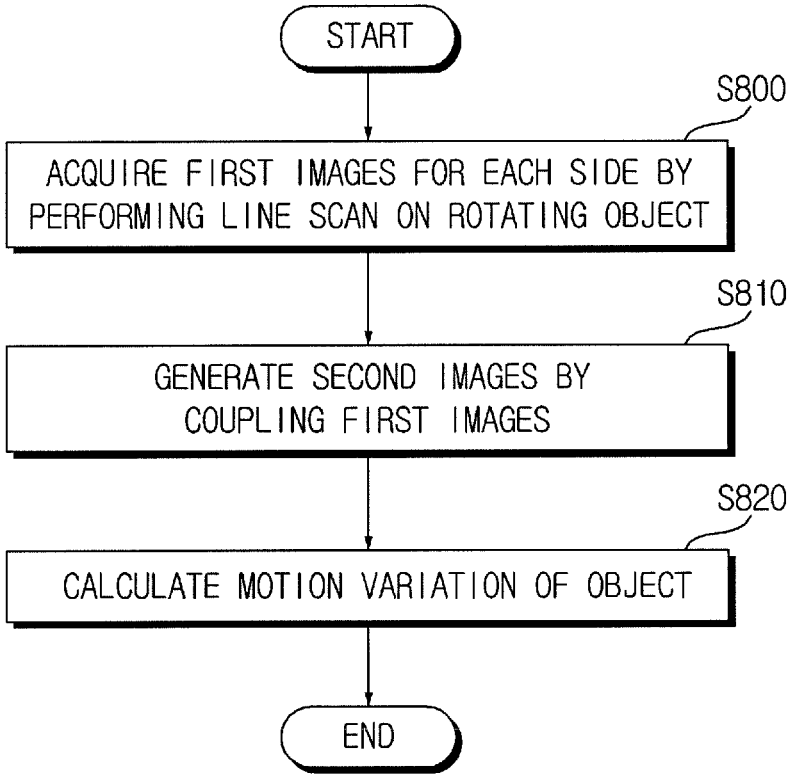
FIG. 8 is a flow chart showing a method for calculating a motion of an object according to an exemplary embodiment of the present invention.

Next, the method for calculating the motion of the object of the object motion calculation device 100 will be described. FIG. 8 is a flow chart showing a method for calculating a motion of an object according to an exemplary embodiment of the present invention. The following description will be described with reference to FIG. 8.

First, the first image for each side by performing the line scan on at least two sides of the rotating object is acquired (image acquiring step (S800)). At the image acquiring step (S800), one side of the object including the object related boundary line is line-scanned.

After the image acquiring step (S800) is performed, the second image including the object is generated by coupling the obtained first images (image generation step (S810)). The image generation step (S810) may include a time coherence information calculation step and an image coupling step. The time coherence information calculation step calculates the time coherence information on each of the first images. The second image is generated by coupling the first images according to the time coherence information calculated at the image coupling step.

After performing the image generation step (S810), the motion variation of the object is calculated based on the generated second images (motion calculation step (S820)). The motion calculation step (S820) may include a reference point extraction step and a motion variation calculation step. The reference point extraction step extracts the predetermined reference point at each of the second images. The motion variation calculation step calculates the three-positional position variation of the reference point by the motion variation, the speed component of the object, and the spin component of the object, based on the extracted reference points.

When calculating the three-dimensional position variation of the reference point by the motion variation, the motion variation calculation step may include a curvature variation calculation step, a depth variation calculation step, a first position variation calculation step, and a second position variation calculation step. The curvature variation calculation step calculates the curvature variation of the object related boundary line for each of the second images. The depth variation calculation step calculates the depth variation of the reference point based on the curvature variation for each of the second images. The first position variation calculation step calculates the two-dimensional position variation of the reference point from the second images. The second position variation calculation step calculates the three-dimensional position variation of the reference point based on the depth variation and the two-dimensional position variation.

When calculating the speed component of the object by the motion variation, the motion variation calculation step may include a third position variation calculation step, a time variation calculation step, and a speed component calculation step. The third position variation calculation step obtains the position component for the reference point in each of the second images to calculate the position variation between the second images. The time variation calculation step calculates the time variation between the second images based on the position component obtained for each of the second images. The speed component calculation step calculates the speed component of the object based on the position variation and the time variation.

When calculating the spin component of the object by the motion variation, the reference point extraction step extracts the unique points having different frame values at each of the second images as the reference point and the motion variation calculation step may include a material frame calculation step and a spin component calculation step. The material frame calculation step calculates the three-dimensional material frame for the second images using the extracted feature points. The spin component calculation step calculates the spin component of the object based on the three-dimensional material frame.

Figure 9:
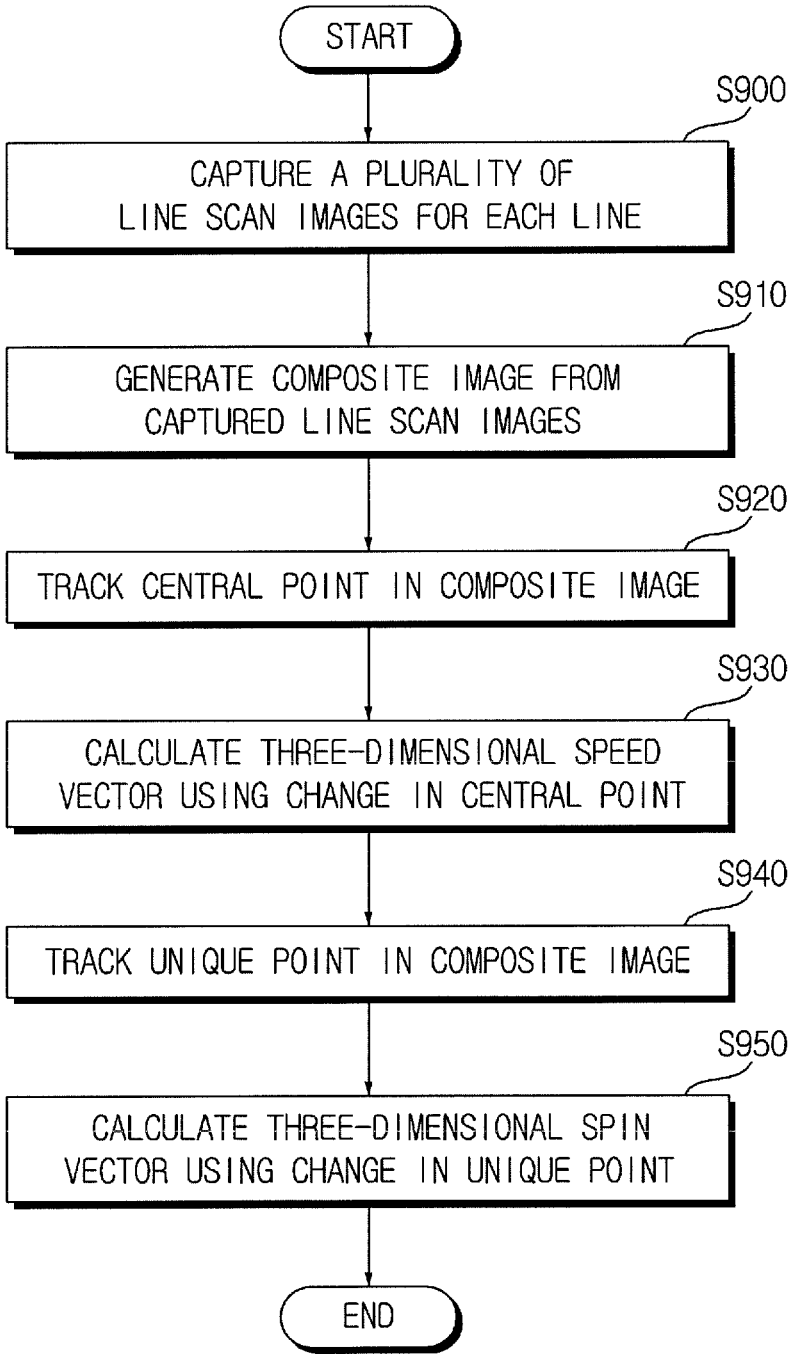
FIG. 9 is a flow chart sequentially showing a method for recognizing a speed and a spin based on the line scan camera device according to an exemplary embodiment of the present invention.

FIG. 9 is a flow chart sequentially showing a method for recognizing a speed and a spin based on the line scan camera device according to an exemplary embodiment of the present invention.

At step S900, the line scan device performs the image capture on the rotation body that is hit, thrown, kicked, or rolled by the user in the simulation game to obtain the plurality of line scan images for each line. Next, at step S910, the composite images are generated by coupling the line scan images obtained at step S900. The two composite images for two line scan cameras are generated. Next, at step S920, the change according to the time is tracked by obtaining the three-dimensional position vector of the central point of the rotation body for each of the two composite images obtained at step S910. Next, at step S930, the three-dimensional speed vector of the rotation body is obtained from the difference in the three-dimensional position vector of the central points and the time difference. Next, at step S940, the change according to the time is tracked by obtaining the three-dimensional position vectors of the feature points of the rotation body for each of the two composite images obtained at step 910. Next, at step S950, the three-dimensional spin vector of the rotation body is obtained from the difference in three-dimensional position vector of the feature points and the time difference.

When the three-dimensional speed and spin of the rotation body obtained in the above are used as the initial values, the realistic physical simulation for the motion orbit such as the flight motion or the ground motion of the rotation body is provided and the game or training contents based on the realistic simulation may be provided. The method for recognizing a speed and a spin of FIG. 9 is based on the inexpensive camera device of FIG. 5, which may be expected as being suitable for the development of the inexpensive realistic game or training system. However, the realistic physical simulation method and the game or training contents manufacturing is beyond the scope of the present invention and therefore, is not handled in detail in the present invention.

The present invention relates to the apparatus and the method for capturing the line scan image and then, measuring the speed of the rotation body based on the captured line scan image and recognizing the spin and may be applied to the game field or the training field, for example, the arcade game field or the sports game field to which the rotation orbit recognizing technology is reflected.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An apparatus for calculating a motion of an object, comprising:

a control unit that predetermines at least one line for which first images of an object will be acquired;

an image acquirement unit that acquires first images for each predetermined line for each side by performing a line scan on at least two sides of the object;

an image generation unit that generates second images including the object by coupling the first images for at least one predetermined line; and a motion calculation unit that calculates motion variation of the object based on the generated second images.

2. The apparatus of claim 1, wherein the image generation unit includes:

a time coherence information calculation unit that calculates time coherence information on each of the first images; and an image coupling unit that generates the second images by coupling the first images with each other according to the calculated time coherence information.

3. The apparatus of claim 1, wherein the motion calculation unit includes:

a reference point extraction unit that extracts a predetermined reference point in each of the second images; and a motion variation calculation unit that calculates three-dimensional position variation of the reference point, speed component of the object, and spin component of the object by the motion variation based on the extracted reference points.

4. The apparatus of claim 3, wherein the motion variation calculation unit includes:

a curvature variation calculation unit that calculates curvature variation of a boundary line relating to the objects for each of the second images;

a depth variation calculation unit that calculates depth variation of the reference point based on the curvature variation for each of the second images;

a first position variation calculation unit that calculates two-dimensional position variation of the reference point from the second images; and a second position variation calculation unit that calculates three-dimensional position variation of the reference point by the motion variation based on the depth variation and the two-dimensional position variation.

5. The apparatus of claim 3, wherein the motion variation calculation unit includes:

a third position variation calculation unit that obtains position component for the reference point in each of the second images to calculate the position variation between the second images;

a time variation calculation unit that calculates time variation between the second images based on the position component obtained for each of the second images; and a speed component calculation unit that calculates speed component of the object by the motion variation based on the position variation and the time variation.

6. The apparatus of claim 3, wherein the reference point extraction unit extracts unique points having different frame values in each of the second images by the reference point, and the motion variation calculation unit includes:

a material frame calculation unit that calculates a three-dimensional material frame for the second images using the extracted unique points; and a spin component calculation unit that calculates the spin component of the object based on the three-dimensional material frame.

7. The apparatus of claim 1, wherein the image acquirement unit performs a line scan on one side of the object including a boundary line relating to the object.

8. A method for calculating a motion of an object, comprising:

predetermining at least one line for which first images of an object will be acquired;

acquiring the first images for each predetermined line for each side by performing a line scan on at least two sides of the object;

generating second images including the object by coupling the first images for at least one predetermined line; and calculating motion variation of the object based on the generated second images.

9. The method of claim 8, wherein the generation of the image includes:

calculating time coherence information on each of the first images; and generating the second images by coupling the first images with each other according to the calculated time coherence information.

10. The method of claim 8, wherein the calculating of the motion includes:

extracting a predetermined reference point in each of the second images; and calculating three-dimensional position variation of the reference point, speed component of the object, and spin component of the object by the motion variation, based on the extracted reference points.

11. The method of claim 10, wherein the calculating of the motion variation includes:

calculating curvature variation of a boundary line relating to the objects for each of the second images;

calculating depth variation of the reference point based on the curvature variation for each of the second images;

calculating two-dimensional position variation of the reference point from the second images; and calculating three-dimensional position variation of the reference point by the motion variation based on the depth variation and the two-dimensional position variation.

12. The method of claim 10, wherein the calculating of the motion variation includes:

obtaining position component for the reference point in each of the second images to calculate the position variation between the second images;

calculating time variation between the second images based on the position component obtained for each of the second images; and calculating speed component of the object by the motion variation based on the position variation and the time variation.

13. The method of claim 10, wherein the extracting of the reference point extracts unique points having different frame values in each of the second images by the reference point, and the calculating of the motion variation includes:

calculating a three-dimensional material frame for the second images using the extracted unique points; and calculating the spin component of the object based on the three-dimensional material frame.

14. The method of claim 8, wherein the acquiring of the image performs a line scan on one side of the object including a boundary line relating to the object.

15. A method for calculating a motion of an object, comprising:

predetermining at least one line for which line scan images of an object will be acquired by a camera;

acquiring the line scan images for each predetermined line for each side by performing a line scan on at least two &des of the object;

generating composite images including the object by coupling the first images for at least one predetermined line;

calculating three-dimentional frames x, y, and t of the object by the following equaion:

$$(x,y,t)=(x,y,(zi+zf)/2)$$

wherein zi=z0×(ri/r0), zf=z0×(rf/f0), wherein z0 is a distance between the object and the camera, r0is a radius of an arc of the acquierd lines scan image, ri and rf are the radiuses of the arcs of a first and last line scan images respectively, zi and zf are lengths of the object of the first and last line scans, and x and y are frames of a central point of a composite image; and calculating motion variation of the object based on the generated composite images.

* * * * *